United States Patent [19]

Bannister et al.

[11] Patent Number: 5,024,153

[45] Date of Patent: Jun. 18, 1991

[54] PRINT DRUM FOR A POSTAGE METER

[75] Inventors: Raymond L. Bannister, Richmond; Frederick C. Close, Great Amwell; Peter J. Loeber, Earith, all of United Kingdom

[73] Assignee: Pitney Bowes Inc., Stamford, Conn.

[21] Appl. No.: 905,896

[22] Filed: Sep. 10, 1986

[30] Foreign Application Priority Data

Sep. 16, 1985 [GB] United Kingdom ..... 8522831

[51] Int. Cl.[5] ..... B41F 13/10; B41F 27/06

[52] U.S. Cl. ..... 101/91; 101/377

[58] Field of Search ..... 101/377, 91, 375, 110, 101/288, 330

[56] References Cited

U.S. PATENT DOCUMENTS

| | | | |
|---|---|---|---|
| 1,401,471 | 12/1921 | Hering | 101/405 |
| 2,641,182 | 6/1953 | Koffski | 101/377 |
| 3,921,516 | 11/1975 | Toft et al. | 101/91 |
| 3,921,783 | 11/1975 | Zeamer | 400/464 |
| 4,144,809 | 3/1979 | Sato | 101/288 |
| 4,252,061 | 2/1981 | Wade, Jr. | 101/377 |
| 4,384,525 | 5/1983 | Sato et al. | 101/288 |
| 4,412,489 | 11/1983 | Duhamel | 101/377 |
| 4,438,698 | 3/1984 | Sullivan, Jr. et al. | 101/91 |
| 4,519,311 | 5/1985 | Lowe | 101/91 |
| 4,580,495 | 4/1986 | Scrudato | 101/330 |

FOREIGN PATENT DOCUMENTS

| | | | |
|---|---|---|---|
| 55-867 | 4/1980 | Japan | 101/77 |
| 328332 | 4/1930 | United Kingdom | 101/91 |

*Primary Examiner*—Clifford D. Crowder

*Attorney, Agent, or Firm*—Charles G. Parks, Jr.; David E. Pitchenik; Melvin J. Scolnick

[57] ABSTRACT

A print drum for a postage meter has a drum structure provided with a plurality of recesses in its periphery. One of these recesses accommodates a print wheel assembly and at least some of the other recesses are provided with axially extending means whereby imprinting dies can be slid in and out. The movement in and out of the recesses is in a direction substantially parallel to the rotation axis of the print drum.

15 Claims, 7 Drawing Sheets

PRINT DRUM FOR A POSTAGE METER

BACKGROUND OF THE INVENTION

This invention relates to a print drum for a postage meter, and to a postage meter including a print drum.

Postage meters, also called franking machines, are well known machines used in the great majority of offices and mailing rooms throughout the industrially developed countries of the world. A print drum operates in a well known manner to make a single revolution at each operation thereby making a franking imprint on an envelope or other package which is to be franked. A print drum contains a print wheel assembly, whereby commonly four digits may be printed, each of the print wheels being rotatable so as to dispose any digit from 0 to 9 at their respective rotational positions i.e. the printing positions, in order to frank any desired currency amount on the envelope or other package. Various complex and ingenious mechanisms have been devised for rotating the print wheels of a print wheel assembly, in accordance with requirements.

Rotation of the print drum is normally effective to place other imprints, besides the franking amount, on an envelope or other package. Different countries have different rules and customs with regard to the nature and number of these extra imprints. For economy of manufacture, it is clearly desirable that a print drum design should be such as to be able to accommodate the maximum number of different imprints needed for any country, or alternatively such lesser number as other countries may require. It will be understood that when this is achieved, the same design of print drum may be used in post age meters intended for use in any country.

U.K. Pat. No. 328,332 discloses a postal franking machine which consists of a printing drum and a magazine drum which carries a plurality of printing dies for printing different monetary value. In operation the appropriate printing die is brought to a transfer location and then slid laterally onto the printing drum. The printing drum rotates between two fixed side plates which prevent lateral movement of the printing die. Further dies may be inserted at spaced locations about the printing drum when it is in a unique rest position. In this arrangement it is necessary to change a printing die each time a different monetary value is to be franked. Furthermore the removal and replacement of dies may be done only when the printing drum is at its rest position, and access to the interior of the drum is severely limited.

It is an aim of the present invention to provide a design of print drum which represents an improvement over prior knowledge.

SUMMARY OF THE INVENTION

According to the present invention, there is provided a print drum for a postage meter, comprising:

a drum structure defining a drum longitudinal axis, an outwardly facing printing region and a plurality of recesses within said printing region, a print wheel assembly housed within said drum structure having means for remotely adjusting the print wheels of said assembly, longitudinal guide means associated with said recesses, at least one imprinting die constructed for sliding movement on said longitudinal guide means in and out of one of said recesses in a direction substantially parallel to said print drum axis, and spring biased detent means for releasably locking the imprinting die in its printing position within the respective drum recess.

In a preferred version of the present invention, the printing drum includes spaced first and second part circumferential driving bands at either side of the printing region. Advantageously, at least one of said driving bands is defined by aligned driving band portions provided on the imprinting die and the drum structure respectively.

Advantageously, one of the recesses is adapted slidably to receive an imprinting die in the form of a dater wheel assembly. It is preferred for the dater wheel assembly to include a plurality of rotatable printer wheels for printing a date, and a respective finger wheel drivably associated with each of said printer wheels.

An important advantage of this arrangement is that a dater wheel assembly, a component which is commonly secured in a print drum, can be slid out axially which means that manual adjustment of the date shown by the date wheels of such an assembly can readily be done. With prior art print drums, it has been found necessary to "pick" over the wheels of the dater assembly using a sharp tool in order to adjust the date each morning before the postage meter is used. This picking over process may well damage the digits of the dater wheels leading to a degradation in the image produced on the franked envelope, and is in any case an irritating and time-consuming procedure.

A further important advantage is that it is possible to design a drum which allows good access to the interior of the drum.

In a preferred embodiment of the invention, the imprint dies referred to are slidable axially into and out of the print drum by virtue of a dovetail-type arrangement.

Other imprint dies which are, or may be, included in a print drum according to the invention are (1) the bulk rate slug, (2) one or more slogan slugs and (3) a multi-slogan slug.

It will be understood that imprint dies are sometimes referred to as "slugs" among postage meter manufacturers and the term "slug" when used in this Specification is to be taken to have this meaning.

In another aspect of this invention, there is provided a postage meter comprising a print drum including a drum structure defining a drum longitudinal axis an outwardly facing printing region and a plurality of recesses within said printing region, a print wheel assembly housed within said drum structure having means for remotely adjusting the print wheels of said assembly, longitudinal guide means associated with said recesses, at least one imprinting die constructed for sliding movement on said longitudinal guide means in and out of one of said recesses in a direction substantially parallel to said print drum axis, spring biassed detent means for releasably locking the imprinting die in its printing position within the respective drum recess, data input means for inputting data relating to the monetary amount to be franked, and counting means for storing a cumulative total of the monetary amount franked.

The invention will be better understood from the following description, which is non-limitative, of one example of a print drum according to the invention, given with reference to the accompanying drawings.

DETAILED DESCRIPTION OF THE PREFERRED EMBODIMENT

Figure 1:
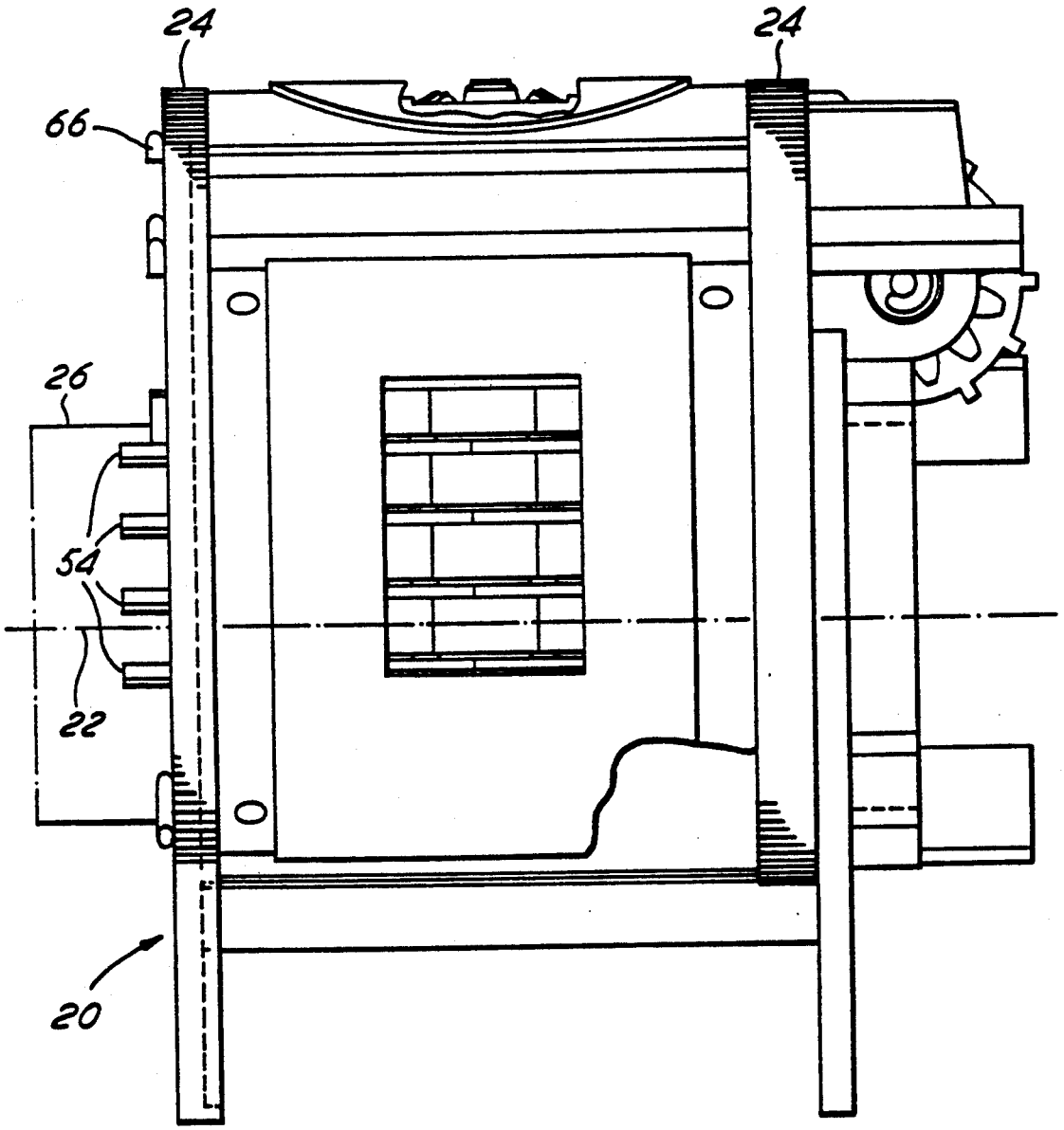
FIG. 1 is a side elevation of one example of print drum according to the invention.

In the drawings, like parts are represented by like reference numerals.

Figure 2:
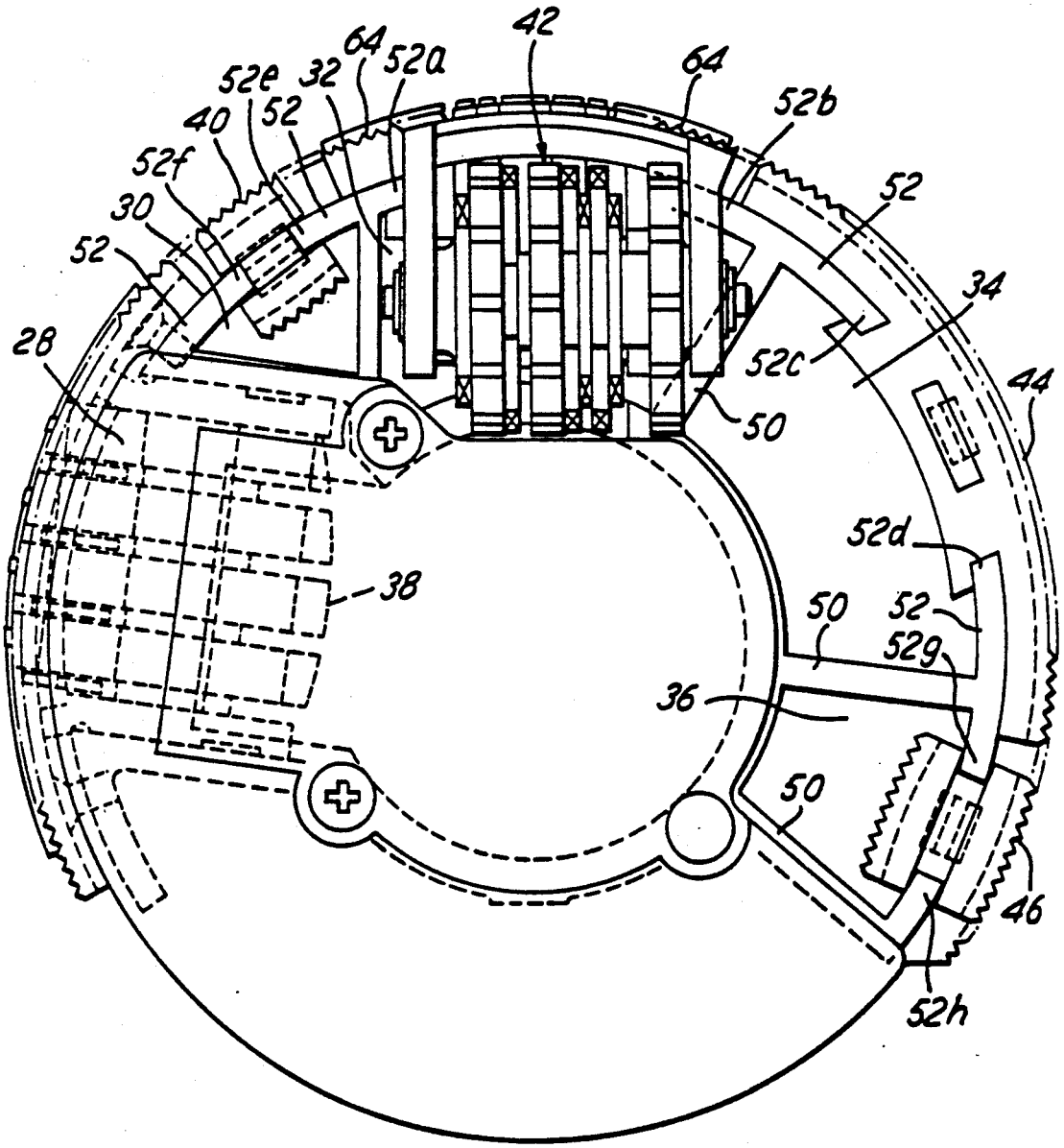
FIG. 2 is an end view, viewed along the axis of the drum, of the print drum shown in FIG. 1.

Referring now to the print drum 20 illustrated in FIGS. 1 and 2, the rotation axis of the print drum is indicated at 22 and the drum has serrations 24 at each end which are provided to define drive hands which engage the surface of an envelope being franked to help it to be driven through the meter without slipping relative to the print drum. The print drum is fixed to a print drum shaft 26 which itself is driven by other mechanisms of the postage meter. These other mechanisms form no part of the novelty of the present invention, and therefore are not described in detail.

The print drum has a number of recesses therein. In the illustrated drum 20, these recesses are five in number, are indicated by reference numerals 28, 30, 32, 34 and 36, and are a recess 28 accommodating the print wheel assembly 38, a recess 30 accommodating a bulk rate slug 40, a recess 32 accommodating a dater wheel assembly 42, a recess 34 accommodating an advertising or an address slug 44, and, finally, a recess 36 accommodating a multi-slogan slug 46. The recesses are defined by the combination of radially extending walls 50 and part-cylindrical walls at the periphery of the drum these being indicated at 52. In the case of the recesses 28 and 32, which accommodate more bulk components, the radial walls 50 do not extend over the complete axial length of the drum 20.

It will be understood that the individual rotational position of each of the print wheels 38, four such wheels being shown, is set by an axially extending rack, parts of these racks being seen at 54 in FIG. 1.

Figure 3:
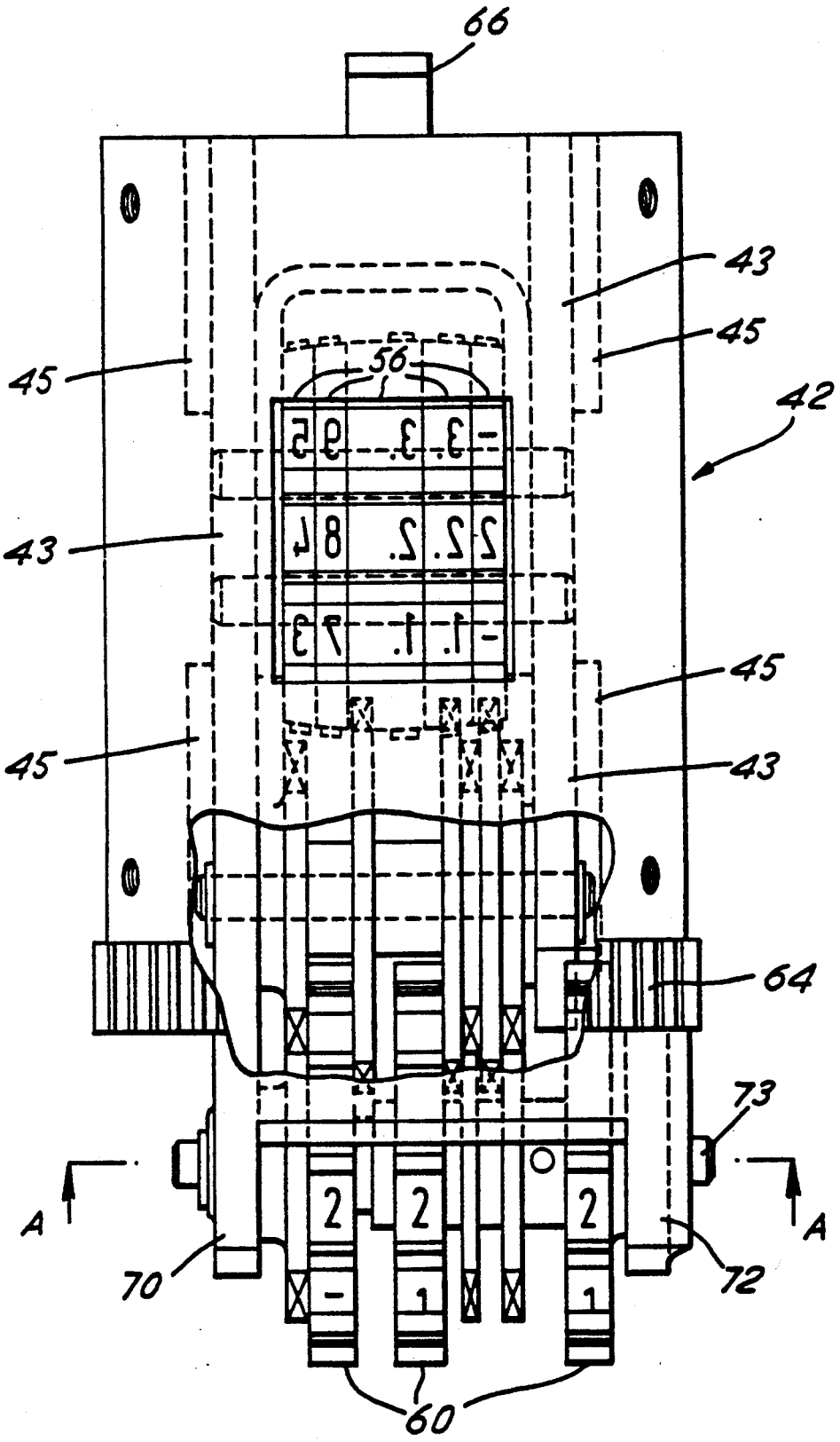
FIGS. 3, 4 and 5 are respectively a top view, side view and end view of one example of dater wheel assembly usable in the print drum of FIGS. 1 and 2.
Figure 4:
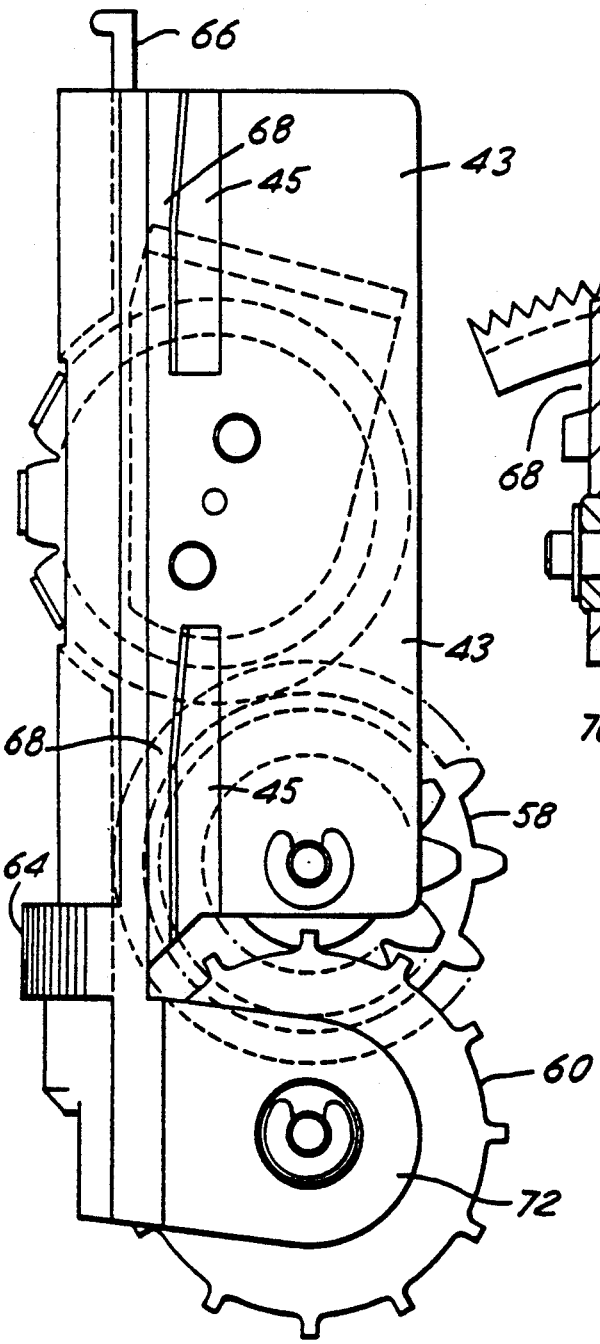
Figure 5:
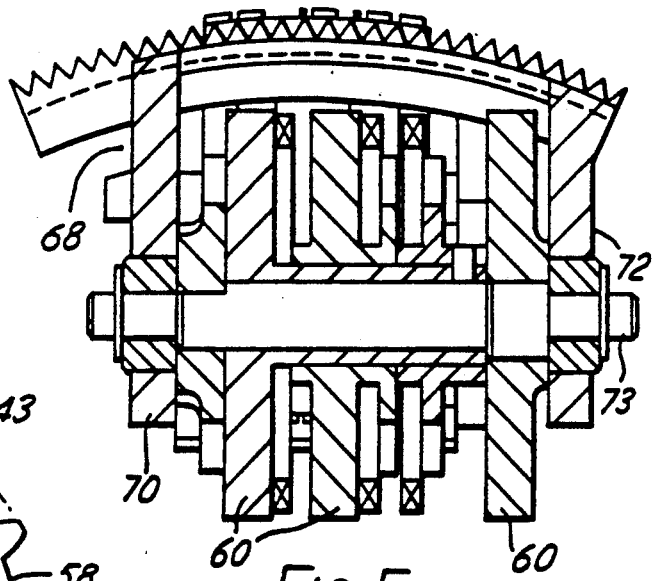

The dater wheel assembly is illustrated in FIGS. 3–5. It includes a bank of five dater wheels 56, each of which is in engagement with a counterpart sprocket wheel 58, each of which, in turn, is in engagement with a counterpart finger wheel 60 only three of which are show. The purposes of this arrangement is so that a user can manually rotate the finger wheel 60 thereby rotating one of the dater wheels so that it shows the required date. The dater wheel assembly 42 has an arcuate wall carrying serrations 64. These serrations together with other slugs and the right hand ring of serrations 24 seen in FIG. 1 constitute a full circle ring of serrations around the drum. The opposite ends of the dater wheel assembly 42 has a resilient flexible detent 66 of hook shape as seen best in FIG. 4. As seen in FIGS. 4 and 5 the dater wheel assembly 42 has side walls 43. Each of these walls has ribs 45 partly defining recesses extending along its length. The recesses at one side being shown at 68 and the other side is similar. The walls 70, 72 extend only part way along the dater assembly and support a shaft 73 which carries the finger wheels 60. The recesses 68 are dimensioned so as to receive the portions 52A, 52B of the peripheral wall 52 of the print drum when the dater wheel assembly 42 is inserted into the print drum in an axial direction, so constituting a dovetail arrangement and locating the assembly 42 firmly and accurately. As will be understood, with this arrangement, the dater wheel assembly can be slid in an axial direction into the print drum and the detent 66 then extends through a suitable hole provided in the left hand wall of the print drum as seen in FIG. 1. Being flexible and resilient, the detent 66 bends slightly to pass through the hole and then springs back to securely retain the dater wheel assembly in position; the assembly can however be removed by a firm pull in the right hand direction as seen in FIG. 1 (i.e. out of the paper as seen in FIG. 2). While a particular dater wheel assembly has been illustrated in FIGS. 3–5, it will be appreciated that dater wheel assemblies of other specific designs could be employed, while still employing the advantageous principle of axial withdrawal of the dater assembly as a whole from the print drum due to the provision of a dovetail kind of arrangement of co-operating parts.

Figure 6:
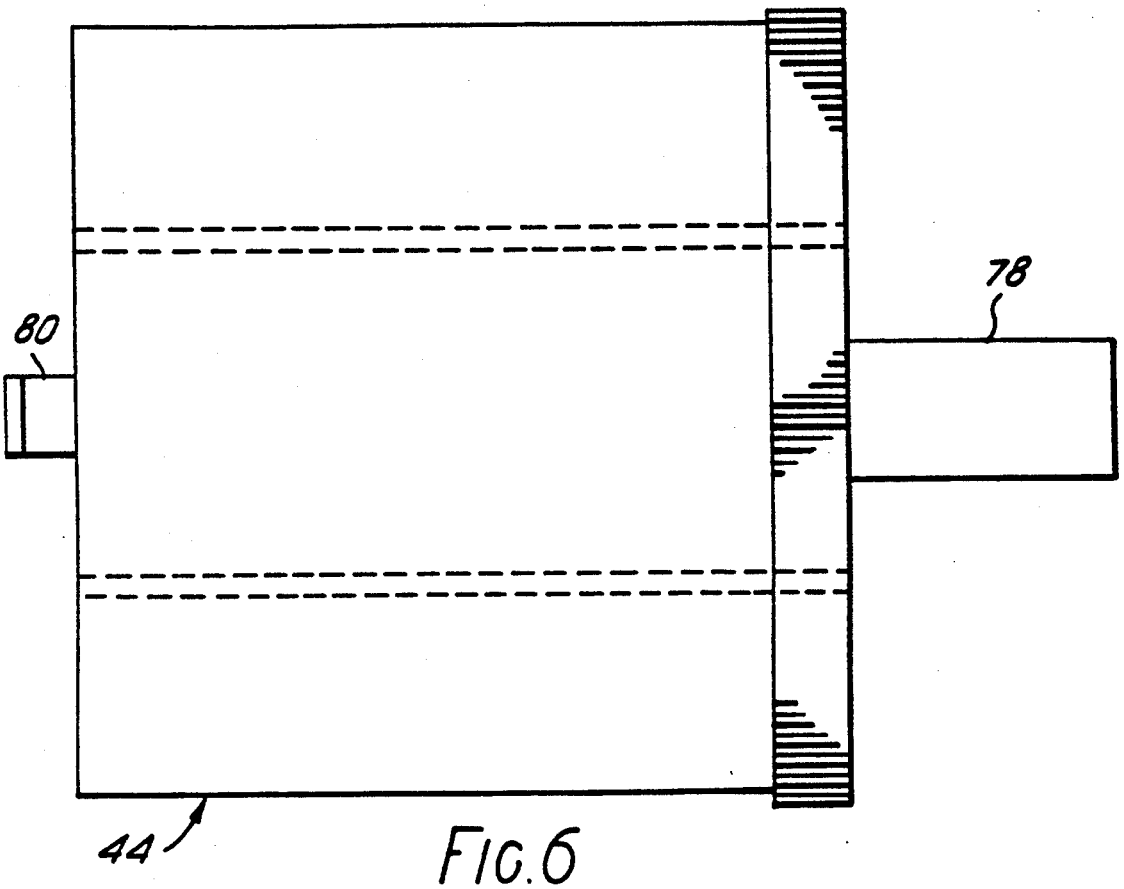
FIGS. 6, 7 and 8 are respectively top view, side view and end view of one example of imprinting slug which may for example carry an advertising slogan which may be used in the print drum according to FIGS. 1 and 2.
Figure 7:
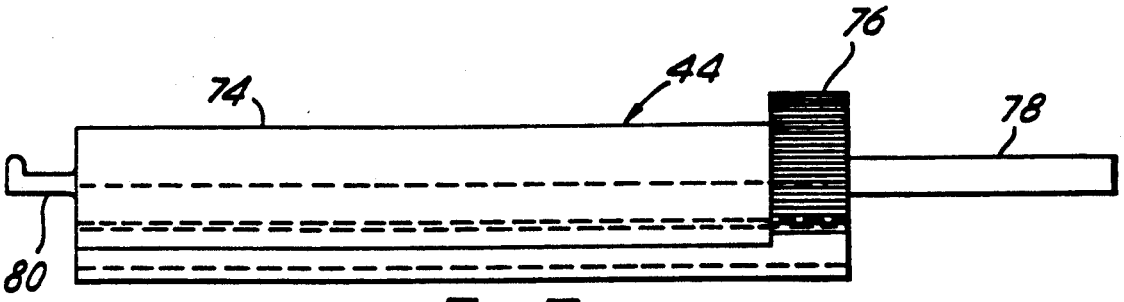
Figure 8:
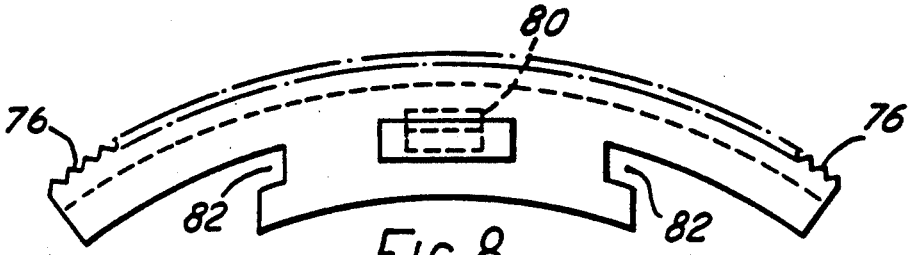

Referring to now to FIGS. 6–8, these illustrate an advertisement and address slug 44 having a part cylindrical surface 74 upon which is disposed an moulded, engraved, etched or otherwise treated plate bearing an advertisement legend, or an address, or other desired information, which it is desired to apply to a franked envelope together with the franking amount by the single rotation of the print drum. The slug 44 has serrations 76 which form a part of the ring of serrations 24 seen in FIG. 1, and includes a gripping tab or handle 78. It also includes a detent 80 which serves a similar purpose to the detent 66 seen in FIG. 4. That is to say, it maintains the slug 44 in position on the print drum but permits its manual removal by application of a suitable axial force. The slug 44 has a dovetail arrangement which includes defining two recesses 82. These receive the portion 52C and 53D of the drum wall 52 as seen best in FIG. 2. In this way, the slug 44 can be slid axially into and out of the drum, as desired, and once mounted in the drum the slug 44 is securely and firmly maintained in position due to the dovetail arrangement and the detent 80.

Figure 9:
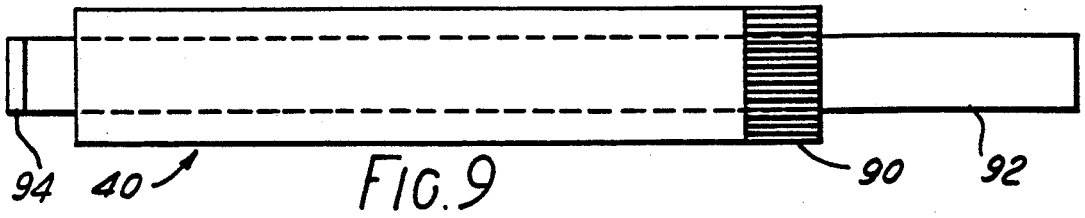
FIGS. 9, 10 and 11 are respectively plan view, side view, and end view (in the axial direction of the print drum) of an imprint die which may for example carry bulk rate information usable in a print drum as shown in FIGS. 1 and 2.
Figure 10:
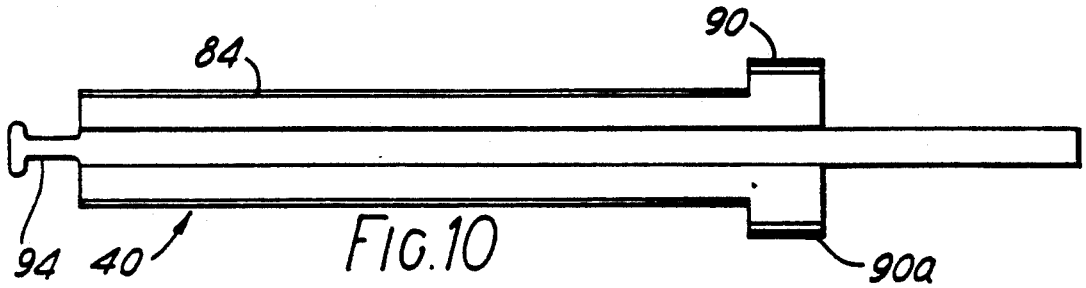
Figure 11:
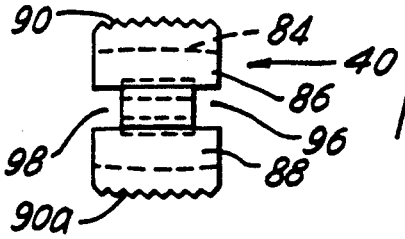

Referring now to FIGS. 9–11, these illustrate the bulk rate slug 40. This has a surface 84 upon which is carried a legend whose wording may be settled appropriately according to the law of the country where the postage meter is to be used and it has upper and lower body portions 86 and 88. A part-ring of serrations 90 serve as part of the ring of serrations 24 seen in FIG. 1. Like serrations 90A are provided on the end of the lower body portion 88. The slug 40 has a gripping tab or handle 92 at one end, and a detent 94 at the other. The function of the detent 94 is the same as that of the detents 66 and 80 already described. The bulk rate slug has recesses 96 and 98 which form a dovetail arrangement and are intended to co-operate with walls 52E and 52F on the print drum 20. The slug 40 is withdrawn by gripping the tab 92 and pulling in an axial direction.

Figure 12:
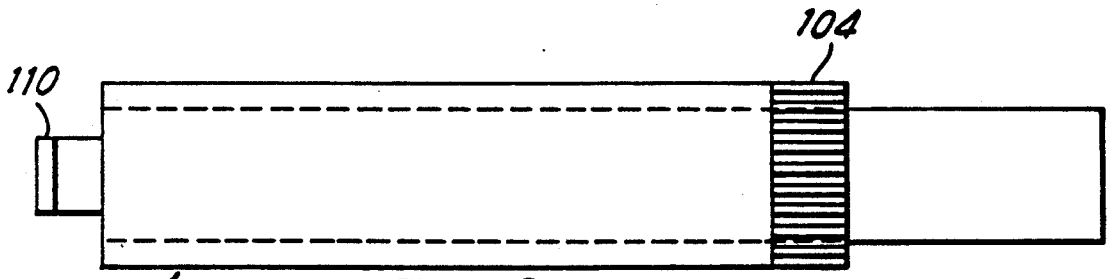
FIGS. 12, 13 and 14 are respectively plan view, side view and end view (in an axial direction of the print drum) of an imprint die (which may for example be a multi-slogan slug) usable in the print drum shown in FIGS. 1 and 2.
Figure 13:
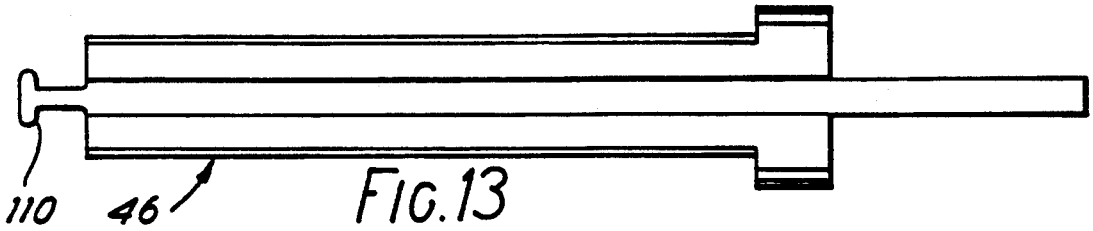
Figure 14:
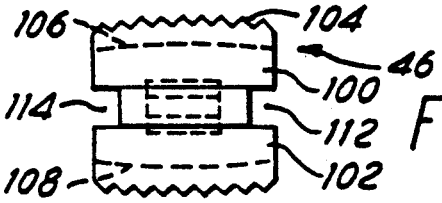
Figure 15A:
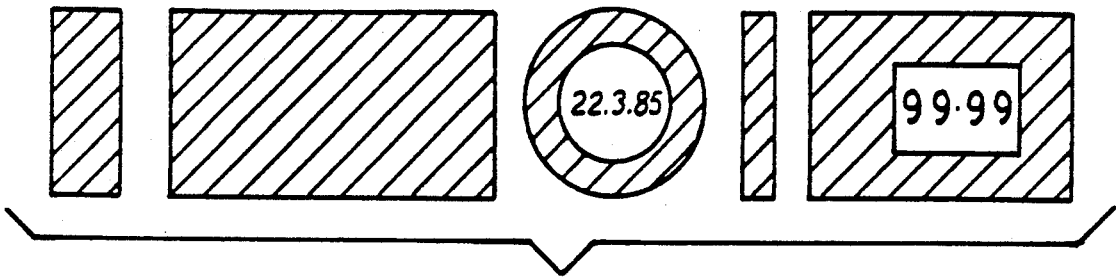
FIG. 15 illustrates the impressions produced by fur different configurations of print drum, model A representing the present invention and models B–D representing various prior print drums.
Figure 15B:
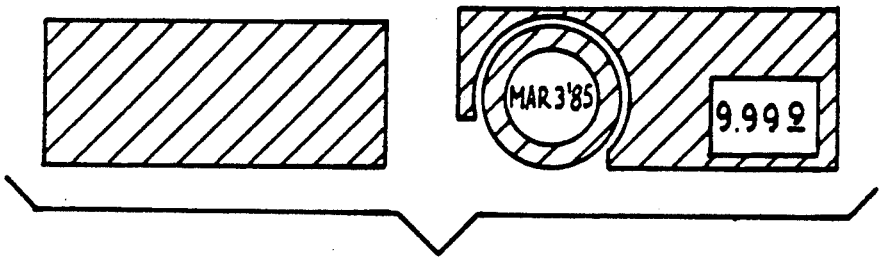
Figure 15C:
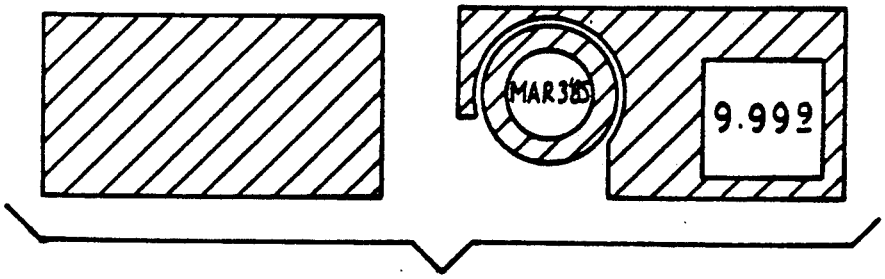
Figure 15D:
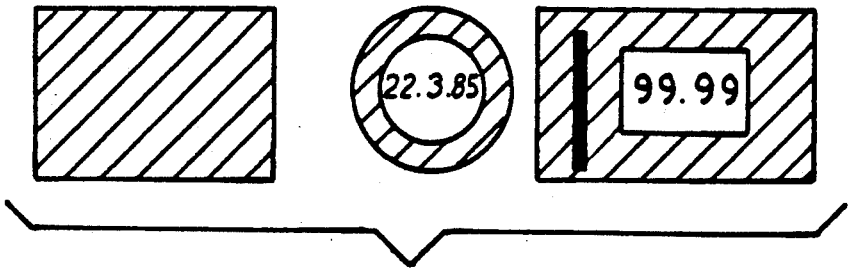

Turning now to FIGS. 12–14, these illustrate what is called a multi-slogan slug and this is in essence similar in construction to the slug already described with reference to FIGS. 9–11. It has an upper and lower body 100, 102, serrations 104, a surface 106 for bearing the desired legend, a surface 108 for bearing an alternative legend, and a detent 110 which serves the same purpose as the detent 94 of FIG. 9. Recesses 112 and 114 are provided to co-operate with wall portions 52G and 52H seen in FIG. 2. The multi-slogan slug 46 is removable in a similar way to the other slugs, by application of a suitable axial force to spring the detent out of engagement with the drum wall, the slug then being withdrawn in an axial longitudinal direction. Of course once withdrawn it may if desired by inverted and re-inserted, so allowing the slogan printed by this particular slug to be readily altered without any rebuilding or complex manipulation of the print drum.

Reverting to the point made relating to provision of increased information-bearing space made available on the print drum according to the invention. FIG. 15 illustrates the impressions produced by 4 different arrangements. Impression A was produced using a print drum according to the invention. Impressions B, C and D were produced by print drums according to various prior art configurations, B and C being suitable for use in U.S.A. and D being suitable for use on the Continent of Europe. It will be readily seen that a print drum according to the illustrated embodiment of the invention makes available over 25% more impression space than the illustrated prior art print drums. Moreover, the print drum disclosed herein for the first time makes it possible to include both a multi-slogan slug and a separate bulk rate slug, with either of these being replaceable.

It is of course possible to modify the design of the drum. For example an extra slug recess may be provided between recess 32 and recess 34 to house an additional slug which would print to the left of the date stamp in impression A of FIG. 15.

Furthermore, it may be preferred, from the point of view of manufacture, for the mating surfaces of the imprinting dies and the print drum structure to be flat.

While a particular construction of print drum has been illustrated, it will be appreciated that the spacing between the slugs can be altered as desired by appropriate design of the drum, and all such obvious or routine alterations are considered to be within the invention.

What is claimed is:

1. A print drum for a postage meter, comprising:

a drum structure defining a drum longitudinal axis, an outwardly facing print region and a plurality of recesses within said printing region, a print wheel assembly housed within said drum structure having means for remotely adjusting the print wheels of said assembly, longitudinal guide means associated with said recesses, at least one imprinting die constructed for sliding movement on said longitudinal guide means in and out of one of said recesses in a direction substantially parallel to said print drum axis, and resilient biassed detent means for releasably locking the imprinting die in its printing position within the respective drum recess.

2. The print drum of claim 1, wherein spaced first and second part circumferential driving bands are provided at respective sides of the printing region.

3. The print drum of claim 2, wherein at least one of said part circumferential driving bands includes aligned driving band portions provided on the imprinting die and the drum structure respectively.

4. The print drum of claim 1, wherein one of said recesses is adapted slidably to receive an imprinting die in the form of a dater wheel assembly.

5. The print drum of claim 4, wherein said dater wheel assembly includes a plurality of rotatable printer wheels for printing a date and a respective finger wheel drivably associated with each of said printer wheels.

6. The print drum of claim 1, wherein the imprinting dies are slidable axially into and out of the print drum by virtue of a dovetail type arrangement.

7. The print drum of claim 1, wherein at least one imprinting die is formed so as to be slidable into a recess in one of two orientations, whereby a single imprinting die is capable of printing two different impressions.

8. The print drum of claim 1, wherein the said recesses are defined in part by radially extending walls and part-cylindrical walls at the drum periphery.

9. The print drum of claim 1, which includes at least the following imprinting dies:

(i) a bulk rate slug, (ii) one or more slogan slugs, and (iii) a multi-slogan slug.

10. An imprinting die for use with a print drum of a postage meter, the die having walls of a configuration and a position such that the die can be slid in a longitudinal direction of the drum into and out of a recess in the drum, the die also including resilient detent means for cooperating with associated means on said drum releasably to lock the die in said drum.

11. A postage meter comprising a print drum including a drum structure defining a drum longitudinal axis, an outwardly facing printing region and a plurality of recesses within said printing region, a print wheel assembly housed within said drum structure having means for remotely adjusting the print wheels of said assembly, longitudinal guide means associated with said recesses, at least one imprinting die constructed for sliding movement on said longitudinal guide means in and out of one of said recesses in a direction substantially parallel to said print drum axis, and resilient biassed detent means for releasably locking the imprinting die in its printing position within the respective drum recess, data input means for inputting data relating to the monetary amount to be franked, and counting means for storing a cumulative total of the monetary amount franked.

12. A print drum structure for the print drum of a postage meter, the structure comprising:

an imprinting-die-retaining structure defining a longitudinal axis and having a plurality of walls extending radially from the axis;

said walls defining between themselves a plurality of recesses each having longitudinal guide means for receiving imprinting dies in a direction substantially parallel to the drum axis; and detent means associated with each recess for releasably locking the imprinting die.

13. A print drum for a postage meter, the print drum comprising:

an imprinting-die-retaining structure having a longitudinal axis and including a plurality of walls extending radially from the axis;

said walls defining recesses between themselves for receiving imprinting dies;

longitudinal guide means on said walls;

a plurality of imprinting dies slidingly movable on said longitudinal guide means in and out of said recesses in a direction substantially parallel to the drum axis and being releasably-lockable therein; and said plurality of imprinting dies, when mounted respectively in the recesses of the imprinting die retaining structure, forming the print drum periphery which includes an outwardly facing print region.

14. The print drum of claim 13 wherein first and second port-circumferential driving bands are provided and at least one of said band includes aligned driving band portions on the imprinting dies and the drum structure respectively.

15. The print drum of claim 13 wherein one of said imprinting dies is a dater wheel assembly.

* * * * *